United States Patent [19]

Finch

[11] 4,162,966

[45] Jul. 31, 1979

[54] FLOTATION OF DEEP MINED COAL WITH WATER-IN-OIL EMULSIONS OF SODIUM POLYACRYLATE

[75] Inventor: Robert E. Finch, Naperville, Ill.

[73] Assignee: Nalco Chemical Company, Oak Brook, Ill.

[21] Appl. No.: 870,559

[22] Filed: Jan. 19, 1978

Related U.S. Application Data

[63] Continuation-in-part of Ser. No. 696,460, Jun. 16, 1976, abandoned, and Ser. No. 807,770, Jun. 20, 1977, abandoned.

[51] Int. Cl.[2] ..... B03D 1/02

[52] U.S. Cl. ..... 209/166; 209/5

[58] Field of Search ..... 209/5, 49, 166; 210/54; 260/29.6 HN, 29.6 NP; 252/61

[56] References Cited

U.S. PATENT DOCUMENTS

| | | | |
|---|---|---|---|
| 3,284,393 | 11/1960 | Vanderhoff | 526/911 X |
| 3,493,501 | 2/1970 | Eck | 210/54 R |
| 3,624,019 | 11/1971 | Anderson | 260/29.6 H |
| 3,734,873 | 5/1973 | Anderson | 260/29.6 H |
| 3,850,618 | 12/1974 | Shubert | 209/5 |
| 3,997,492 | 12/1976 | Kane | 260/29.6 HN |
| 4,024,216 | 5/1977 | Finch | 210/54 A |

FOREIGN PATENT DOCUMENTS

| | | | |
|---|---|---|---|
| 1002702 | 2/1957 | Fed. Rep. of Germany | 209/166 |
| 1064442 | 9/1959 | Fed. Rep. of Germany | 209/166 |
| 703922 | 2/1931 | France | 209/166 |
| 903853 | 8/1962 | United Kingdom | 209/5 |
| 121385 | 6/1958 | U.S.S.R. | 252/61 |

OTHER PUBLICATIONS

Chem. & Tech. of Coal, Agroskin, Published for U.S. Dept. of Int. & NSF, by Israel Program for Sci. Translations, 1966, pp. 33–43.

Chem. Abst., 82, 1975, 88349x.

Chem. Abst., 83, 1975, 62404g.

*Primary Examiner*—Robert Halper

*Attorney, Agent, or Firm*—John G. Premo; Robert A. Miller; John S. Roberts

[57] ABSTRACT

A method and treating agent for increasing the yield of deep mined coal mined from a site 100 feet or more below the surface where the particles in the coal are concentrated by froth flotation. This method consists of utilizing as a promoter or frothing aid about 0.05–1.5 lbs of sodium polyacrylate latex per ton of dry coal (0.017–0.5 lb of dry sodium polyacrylate per ton of dry coal), having an average molecular weight of about 100,000 to 1,000,000 and more, with a preferred range of 1,000,000 or more.

The preferred promoter or frothing aid for deep mined coal is a water-in-oil latex of sodium polyacrylate preferably used with an alcohol-type frother. The latex may be utilized neat and self inverts with the assistance of an oil-in-water surfactant (or activator) and the water in the system upon application to form an oil-in-water emulsion, or it may be used as a two-part system with an activator (aqueous) to promote inversion. The latex emulsion has demonstrated superiority as a flotation promoter for deep mined coal over the dry polymer and exhibits synergism over the dry polymer and over the components of the latex emulsion including a paraffin solvent, a hydrophobic emulsifier such as sorbitan monooleate, a solvent such as Espesol 3-E (Charter; an aromatic blend) and stabilizers such as polyisobutylene and aluminum tristearate.

5 Claims, No Drawings

FLOTATION OF DEEP MINED COAL WITH WATER-IN-OIL EMULSIONS OF SODIUM POLYACRYLATE

This application is a continuation-in-part of pending Ser. No. 696,460 now abandoned filed June 16, 1976, of Robert E. Finch which dealt with sodium polyacrylate as a promoter for oxidized coal, and pending Ser. No. 807,770 now abandoned filed June 20, 1977, which dealt with the flotation of oxidized coal with a latex emulsion of sodium polyacrylate wherein said emulsion was a readily invertible water-in-oil latex.

The primary source of retrieval of coal presently in this country is so-called deep mined coal. This coal is coal that is mined from a substantial distance from the surface of the earth or at a depth of 100 feet or more. The coal is taken directly to a preparation plant to exclude weathering or oxidation from the atmosphere. Deep mined coal may be also defined as a coal whose oxygen content does not increase 1% from the source to its preparation. It is realized that all types of coal have innate oxygen content in the natural state and oxygen content of all coals including deep mined coal varies as is apparent from the following citation, A. A. Agroskin, Chemistry and Technology of Coal, 1961, page 33, translated by the Israel Program for Scientific Translations 1966:

| | |
|---|---|
| Carbon | 77.9–88.3% |
| Hydrogen | 4.2–5.7% |
| Nitrogen | 1.0–1.7% |
| Oxygen | 5.2–16.2% |

However, it is found that deep mined coal which is transported without delay to the point of coal preparation and processing avoids the deleterious effect on flotation caused by weathering or oxidation. Further it has been found that where the weathering or oxidizing is kept below 1% the flotation characteristics of the coal are more favorable than coal which by some means has weathered 1% or greater.

This deleterious effect of an increase of oxygen in coal has been noted by several authors, e.g., S. C. Sun, "Part 3. Froth Flotation," in Coal Preparation, eds. Joseph W. Leonard and David R. Mitchell, 3d Edition, The American Institute of Mining, Metallurgical, and Petroleum Engineers, Inc., New York, 1968, page 10–67, "The unfloatability of oxygen and mineral matter is indicated by the nonfloatable lignite and animal charcoal. The deleterious effect of oxygen on the floatability of coals and coke has been described. . . ."

Also, the problem of oxidation and time is approached by D. J. Brown, Chapter 20, "Coal Flotation," pages 518–537. At page 526 in the section entitled "The Effect of Weathering and Oxidation on Coal Floatability," the author states that "Freshly mined coal generally floats better than that which has been exposed to the atmosphere for a few hours or days. The effect is attributed to surface oxidation which takes place readily at normal atmospheric temperatures, is characterised by the formation of acidic groups at the coal surface, and results in a reduction of the hydrophobicity and floatability of the coal." Where coal is artificially oxidized using potassium permanganate solution, the author states that there is also a loss of floatability and the water-receding contact angle is reduced to zero, although the water-advancing angle remains high. Brown also restates the fact that reactivity towards oxygen varies with the rank of coal. Low rank coals are readily oxidized and lose much of their floatability, but there is a general decrease of reactivity as the carbon content increases.

So-called strip mined coal, which is outside the gambit of this invention, is defined as coal which has been removed from near the surface of the earth or less than 100 feet deep and which has weathered or increased its native oxygen content by 1% or more. Into this category of weathered or strip mined coal would also be included deep mined coal which has been brought to the surface and allowed to weather or oxidize for a substantial period of time to increase the oxygen content 1% or more and unfavorably influence the floatability of the coal.

As is known, flotation is a process for separating finely ground minerals such as coal particles from their associate waste or gangue by means of the affinity of surfaces of these particles for air bubbles, which is a method for concentrating coal particles. In the flotation process a hydrophobic coating is placed on the particles which acts as a bridge so that the particles may attach to the air bubble and be floated, since the air bubble will not normally adhere to a clean mineral surface such as coal.

In froth flotation of coal a froth is formed as aforesaid by introducing air into a so-called pulp which contains the impure finely divided coal particles and water containing a frothing agent. The flotation separation of coal from the residue or gangue depends upon the relative wettability of surfaces and the contact angle, which is the angle created by the solid air bubble interface.

In the development of flotation to date, three general classes of reagents have been utilized: (1) collectors or promoters, (3) modifiers, and (3) frothers.

The promoters consist almost exclusively in this art of kerosene and fuel oil.

Modifiers are such regulating agents as pH regulators, activators, depressants, dispersants, and flocculants.

A frothing agent is utilized to provide a stable flotation froth persistent enough to facilitate the coal separation but not so persistent that it cannot be broken to allow subsequent handling. Examples of commonly used frothing agents are pine oil, creosote, cresylic acid, and alcohols such as 4-methyl-2-pentanol. Alcohol frothers are preferred in the present invention and additional alcohols are illustrated by amyl and butyl alcohols, terpeneol and cresols. An additional preferred alcohol is methyl isobutylcarbinol (MIBC), which is an aliphatic alcohol in common use as a frother.

The present treating agents which are water-soluble polyacrylates are useful as promoters and frothing aids.

PRIOR ART

U.S. Pat. No. 2,740,522 Aimone et al—The patentee utilizes water-soluble polymers in amounts 0.001 lbs/ton to 1.0 lbs/ton with a preferred amount of 0.01 lbs/ton to 0.2 lbs/ton. Example 16 (column 7) shows the flotation of Pennsylvania anthracite coal fines conditioned with 0.2 lbs/ton of the sodium salt of hydrolyzed polyacrylonitrile to produce a rougher concentrate. A second portion of the example utilizes 0.5 lbs/ton of polymer. This patent appears equivalent to British Pat. No. 749,213.

U.S. Pat. No. 3,696,923 Miller—Concentration of coal by flotation.

U.S. Pat. No. 3,408,293 Dajani—Concentration of coal fines and clay by means of a sequential addition of an anionic polymer followed by a cationic polymer to form a floc.

The above prior art did not deal with the problems envisaged with the attempts to use flotation concentration of an invertible water-in-oil emulsion on deep mined coal.

THE TREATING AGENT

The treating agent for the present invention may be defined as a promoter or frothing agent which is a latex or water-in-oil emulsion of a water-soluble anionic linear addition polymer of a polymerizable monoethylenically unsaturated compound having an average molecular weight of about 100,000 to 1,000,000 and more, with a preferred molecular weight of about 1,000,000 or more.

A specially preferred promoter or frothing aid is sodium polyacrylate. The dosage of this latter treating agent is in the range of 0.05–1.5 lbs of sodium polyacrylate latex per ton of dry coal (0.017–0.5 lb of dry sodium polyacrylate per ton of dry coal) and it is utilized conventionally as a 0.5–2% solution. Utilization has resulted in a 64.6% coal recovery as opposed to 16.4% recovery when using the dry polymer precipitate of sodium polyacrylate.

Also operable in the present invention, together with the anionic sodium polyacrylate, are minor percentages of the non-anionic sodium polyacrylamide in the form of a mixture or copolymer wherein the percentile of polyacrylamide is up to 25% of the total. Such addition of polyacrylamide does not modify the basic anionic character of the polymer, which is a necessary criteria.

TABLE 1

| Coal Flotation Using Latex Polymers | | | |
|---|---|---|---|
| | Dosage (lbs/ton) | | |
| Promoter | Effective | Equivalent to Latex | % Coal Recovery |
| 1) Sodium polyacrylate latex emulsion | 0.3 | 0.3 | 64.6 |
| 2) Sodium polyacrylate dry | 0.1 | 0.3 | 16.4 |
| 2a) Sodium polyacrylate dry | 1.0 | 3.0 | 36.6 |
| 3) Azo-bis-isobutyronitrile | 0.006 | 0.3 | 37.3 |
| 3a) Azo-bis-isobutyronitrile | 0.06 | 3.0 | 34.5 |
| 4) Sorbitan monooleate (SPAN 80, ICI) | 0.0066 | 0.3 | 20.1 |
| 4a) Sorbitan monooleate (SPAN 80, ICI) | 0.066 | 3.0 | 32.2 |

The results above for parallel studies in oxidized coal indicated the superiority of the latex form. For example, in Table 1 above, Promoter No. 1 showed 64.6% coal recovery and included the reaction to the latex emulsion containing sodium polyacrylate and ingredients 3 and 4. The individual effect of the dry precipitate 2 at 16.4 and 36.6, depending on concentration, are also given. The individual effect of the azo initiator and the emulsifier (SPAN 80) are set out.

TABLE 2

| Comparative Activity of the Promoter with Latex Polymers | | | | | |
|---|---|---|---|---|---|
| Run No. | Frother | Dosage (lb/ton) | Promoter | Dosage (lb/ton) | % Recovery* |
| 1 | MIBC** | 0.2 | LOPS*** | 0 | 0 |
| 2 | " | 0.2 | " | 0.11 | 2.6 |
| 3 | " | 0.2 | " | 0.27 | 3.0 |
| 4 | " | 0.2 | " | 0.48 | 6.3 |
| 5 | " | 0.2 | " | 0.74 | 10.6 |
| 6 | " | 0.2 | #2 Fuel Oil | 0.80 | 44.9 |
| 7 | " | 0.2 | " | 0.50 | 18.7 |
| 8 | " | 0.2 | " | 0.30 | 7.0 |
| 9 | " | 0.2 | Latex Polymer A2 | 0.20 | 10.7 |
| 10 | " | 0.2 | " | 0.30 | 15.1 |
| 11 | " | 0.2 | " | 0.40 | 18.0 |
| 12 | " | 0.2 | Latex Polymer 2 & Fuel Oil | 0.30<br>0.50 | 40.9 |

*% Recovery is on total solids, not actual coal in float
**Methyl isobutylcarbinol
***Low odor paraffin solvent
Coal: An analogous study using oxidized coal
Polymer A2 is derived from monomer starting material A at page 8 post.

It is noted that, with reference to Runs 2 (utilizing LOPS) and 11 (utilizing the latex emulsion polymer) and considering that the amount of LOPS in the starting material is in the range 20–30%, the activity indicated in the percent recovery of coal shows a distinct increase of from 2.6 to 18.0

THE LATEX

The preparation of the water-in-oil latex from monomers, its polymerization to a water-in-oil emulsion, and its subsequent inversion to an oil-in-water emulsion in use are described in one or more of the following patents:

U.S. Pat. No. 3,997,492 Kane et al
U.S. Pat. No. 3,624,019 Anderson et al
U.S. Pat. No. 3,734,873 Anderson et al
U.S. Pat. No. 3,826,771 Anderson et al A monomer starting material (A) useful for frothing oxidized coal has a composition as follows:

| | |
|---|---|
| Water | 27.0 |
| Caustic soda (50%) | 23.0 |
| Acid acrylic glacial | 20.9 |
| Low odor paraffin solvent (LOPS) | 19.3 |
| Sorbitan monooleate SPAN 80, ICI) | 1.0 |
| Azo-bis-isobutyronitrile (catalyst) | 0.03 |
| Espesol 3-E (a liquid aromatic hydrocarbon blend, Charter International) | 8.5 |
| Polyisobutylene (stabilizer) | 0.27 |
| Aluminum tristearate (stabilizer) | 0.0002 |

The polymerized sodium polyacrylate may be produced by polymerization of, for example, the above recipe according to the teachings of U.S. Pat. No. 3,284,393 Vanderhoff et al using a free radical type catalyst.

A typical water-in-oil polymeric emulsion contains (1) from between 10–50% by weight of sodium polyacrylate (2) from 5–25% by weight of the emulsion of an aliphatic hydrocarbon liquid (3) from 70–95% by weight of the emulsion of an aqueous phase consisting of water and polyacrylate (step 1)

(4) from about 5% by weight of hydrophobic surfactants capable of forming a stable emulsion of the monomers (e.g., alkylated hydrocarbons such as toluene and xylene).

The above-noted composition is not self inverting but a variety of inverting techniques are set out in U.S. Pat. No. 3,624,019 (supra) at column 3, lines 49–57. The presence of any of a group of activators will cause the polymer emulsion to self invert. Such activators may be selected from:

(1) Surfonic N-95 (Jefferson Chemical Co.), a nonylphenol with 10 moles ethylene oxide (2) Triton N-101 (Rohm & Haas), nonylphenoxy polyethoxyethanol (3) Makon 10 (Stepan Chemical Co.), alkyl phenoxy polyoxyethylene ethanol (4) Igepal CO 630 (GAF), nonylphenoxy poly(ethyleneoxy)ethanol.

In the present case the activator may be placed in a separate vehicle with water. Alternatively, an activator may be added later to the polymerized composition for a self invert mode. An explanation of the action of the inversion technique is that a normal latex will generally be added to water containing a hydrophilic surfactant, as, for example, Surfonic N95, thereby causing the emulsion to invert and allowing the polymer previously in the discontinuous phase to wind up in the continuous phase of the water-in-oil emulsion. This, of course, allows the polymer to solubilize. For self-inverting emulsions, the same original emulsion is carefully balanced so that, when added to water, the emulsion inverts, thereby allowing the polymer to solubilize.

TABLE 3

EXAMPLE 1

Treatment of Deep Mined Coal with Treating Agent

| | | Feed | | Float | | Tail | | | |
|---|---|---|---|---|---|---|---|---|---|
| Run | Treatment* | % Solids | % Ash | % Solids | % Ash | % Solids | % Ash | % Recovery | Coal |
| 6 | Blank | 9.7 | 20.7 | 30.9 | 6.6 | 3.7 | 57.7 | 85.3 | Pocahontas |
| 7 | 0.4 #/ton | 10.1 | 22.2 | 32.0 | 6.6 | 7.0 | 40.8 | 65.2 | Pocahontas |
| 11 | 0.3 #/ton | 6.3 | 17.6 | 35.4 | 4.7 | 2.3 | 75.8 | 94.7 | Pocahontas |

*In this series of tests the treating agent was prepared from Monomer A described on page 8, ante, which is polymerized according to Vanderhoff 3,284,393 and the proportion is used as set out at page 9, ante, and is Polymer A Results: This preliminary study shows increased recovery rate in at least one run. Separate studies in three different widely distributed coal mines have confirmed the preliminary results shown above for increased recovery utilizing a polyacrylate emulsion type treating agent such as Treating Agent A. These latter studies showed the use of the water-in-oil emulsion of sodium polyacrylate composition significantly increased the recovery of deep mined coal in three divergent coal mines, one from 78.7% to 90.8%, another from 85.3% to 97.4%, and another from 91.3% to 93.6%.

TABLE 4

EXAMPLE 4

Treatment of Deep Mined Coal with Latex Treating Agent

| | Filter Cake Yield Dry Weight | | Clean Coal Ash | | % Solids-Tailings | | Tailings Ash | |
|---|---|---|---|---|---|---|---|---|
| Coal | Before | Polymer A | Before | Polymer A | Before | Polymer A | Before | Polymer A |
| #1 | 1141.2g | 2087.6g | 5.74 | 4.92 | 5.80 | 1.62 | 49.62 | 73.12 |
| #4 | 927.2g | 1445.2g | 6.59 | 5.62 | 5.18 | 2.40 | 58.18 | 76.47 |
| #2 & #5 | 352.7g | 1578.3g | 10.56 | 11.12 | 8.86 | 4.23 | 53.83 | 52.60 |

Referring to Table 4, the coal was uniformly treated with 3.5 gallons per hour of promoter feed which was achieved by feeding 270 gallons of 1.3% solution on an hourly basis. This treating agent was prepared from Monomer A described on page 8, ante, which is polymerized according to Vanderhoff U.S. Pat. No. 3,284,393 and the proportion is used as set out at page 9, ante, and is Polymer A.

The evaluation above is to determine tons of solids in the froth cell tailings before and after the addition of the promoter. This was done by multiplying the flow rate leaving the float cells by the percent solids and specific gravity of the tailings. To convert to tons per hour, multiply appropriate factors of 8.34 pounds per ton and 60 minutes per hour and divide by 2,000 pounds per ton as given by the formula:

$$TPH = \frac{\text{Flow Rate } GPM \times 8.34\#/\text{Gal} \times 60\text{ min/hr} \times \text{Specific Gravity} \times \%\text{ Solids Slurry}}{2{,}000\#/\text{Ton}}$$

Results of the calculations were:

| Coal | Solids in Tailings | | |
|---|---|---|---|
| | Before | With Polymer A | Difference |
| #1 | 59 TPH | 17 TPH | 42 TPH |
| #4 | 53 TPH | 24 TPH | 29 TPH |
| #2 & #5 | 90 TPH | 43 TPH | 47 TPH |

Also calculations showed the following filter cake yield:

| Coal | Filter Cake Yield | | |
|---|---|---|---|
| | Before | With Polymer A | Difference |
| #1 | 42 TPH | 77 TPH | 35 TPH |
| #4 | 34 TPH | 53 TPH | 19 TPH |
| #2 & #5 | 13 TPH | 58 TPH | 45 TPH |

I claim:

1. A method of increasing the yield of deep mined coal undergoing a concentration treatment of froth flotation by using as a flotation promoter an invertible water-in-oil emulsion of sodium polyacrylate latex in a dosage calculated as 0.017–0.5 lb of dry sodium polyacrylate per ton of dry coal and recovering a concentrate of said coal in said froth.

2. The method of claim 1 wherein the water-in-oil emulsion contains said sodium polyacrylate, latex a paraffinic solvent, a water-in-oil emulsifier, an oil-in-water activator, and a minor amount of stabilizers.

3. The method of claim 1 wherein the water-in-oil sodium polyacrylate latex emulsion inverts on usage and contact with water to an oil-in-water emulsion.

4. The method of claim 2 wherein the oil-in-water activator is added separately.

5. A method of treating deep mined coal undergoing froth flotation which comprises applying to said coal an invertible water-in-oil emulsion of sodium polyacrylate in a dosage calculated as 0.017–0.5 lb of dry sodium polyacrylate per ton of dry coal and conforming to the following formula:

(a) from 5–25% by weight of the emulsion of an aliphatic hydrocarbon liquid;

(b) from 70–95% by weight of the emulsion of an aqueous phase consisting of water and from between 10–50% by weight of the emulsion finely divided particles of water-soluble sodium polyacrylate;

(c) about 5% by weight of the emulsion of hydrophobic surfactants capable of stabilizing said emulsion;

and recovering a concentrate of said coal in said froth.

* * * * *

UNITED STATES PATENT OFFICE

CERTIFICATE OF CORRECTION

Patent No. 4,162,966 Dated JULY 31, 1979

Inventor(s) ROBERT E. FINCH

It is certified that error appears in the above-identified patent and that said Letters Patent are hereby corrected as shown below:

Line 2 of Claim 2:
emulsion contains said sodium polyacrylate, [latex] a
should read:

emulsion contains said sodium polyacrylate, a

Signed and Sealed this

[SEAL] *Twenty-third* Day of *October 1979*

*Attest:*

RUTH C. MASON
*Attesting Officer*

LUTRELLE F. PARKER
*Acting Commissioner of Patents and Trademarks*